United States Patent [19]

Beck

[11] 3,944,215

[45] Mar. 16, 1976

[54] SHEET FEEDING APPARATUS

[75] Inventor: Christian A. Beck, Ridgefield, Conn.

[73] Assignee: Pitney-Bowes, Inc., Stamford, Conn.

[22] Filed: Nov. 18, 1974

[21] Appl. No.: 524,455

[52] U.S. Cl. ..... 271/22; 271/115

[51] Int. Cl.[2] ..... B65H 3/06

[58] Field of Search ..... 271/21, 22, 23, 114, 115, 271/116; 74/214–216, 453

[56] References Cited

UNITED STATES PATENTS

| | | | |
|---|---|---|---|
| 938,006 | 10/1909 | Maegly | 271/22 |
| 3,279,787 | 10/1966 | Niccoli | 271/21 |
| 3,773,316 | 11/1973 | Stemmle | 271/22 |
| 3,857,558 | 12/1974 | Patel | 271/22 |

*Primary Examiner*—Evon C. Blunk
*Assistant Examiner*—Robert Saifer
*Attorney, Agent, or Firm*—William D. Soltow, Jr.; Albert W. Scribner; Donald P. Walker

[57] ABSTRACT

To rotate sheet engaging means such as a roller disposed in engagement with an outermost sheet of a stack sheets in a receptacle, there is provided sheet feeding apparatus including first and second rotatable members, wherein the first member has inwardly and outwardly facing surface portions which respectively define oppositely facing paths of travel when the first member is rotated, and wherein the second member is disposed in the respective paths of travel. The surface portions of the first member are arranged relative to one another to permit one of them to rotate the first member in one direction and the other of them to rotate the first member in the opposite direction, when the first member is rotated in a given direction. Since the second member may be connected to a sheet engaging roller for rotating the roller in opposite directions, the sheet feeding apparatus is usable in buckle-loop sheet feeding systems.

7 Claims, 6 Drawing Figures

12
14
22
18
140
30
32
34
35
36
38
20
50
52
54
56
60
62
64
66
72
74
76
78
80
84
112
134
136
138
142
144
146
148

SHEET FEEDING APPARATUS

BACKGROUND OF THE INVENTION

Commercially available electrostatic copying machines, or copiers, of the type wherein a dry process is utilized for developing an electrostatic latent image formed on a moving photoconductor, and wherein the developed image is thereafter transferred from the photoconductor to a sheet of paper, are generally provided with a suitably constructed receptacle for carrying a stack of paper sheets and apparatus for feeding sheets, one at a time, from the stack and into contact with the photoconductor for image transferring purposes.

The receptacle typically includes a base wall, an upright front wall having a lip, an upright rear wall and means for adjusting the respective front and rear walls against the front and rear end edges of the stacked sheets, with the front wall lip partially overhanging the stack. And, the apparatus for feeding the sheets from the stack typically includes a drive shaft having a friction roller fixedly attached thereto for engaging the upper surface of the top sheet of the stack; and means for alternately rotating the drive shaft, and thus the attached roller, in opposite directions so as to cause the roller to initially urge the front end of the engaged sheet out from beneath the overhanging front wall lip, and then urge the engaged sheet over the front wall and out of the receptacle.

The various prior art means for oppositely rotating the drive shaft of the sheet engaging roller, typically include mechanisms which comprise a redundancy of gears and shafts, pulleys and belts, sprocket wheels and chains, or the like, which are alternately connected to the drive shaft to rotate the shaft, and thus the attached roller, in opposite directions. In addition to being expensive to design, execute, adjust and maintain, the redundant structure calls for the provision of complex control systems which add to the already inordinate demand for space required by such mechanism.

Accordingly, an object of the present invention is to provide improved apparatus for feeding sheets from a stack of sheets;

Another object is to provide, in sheet feeding apparatus of the type which includes means for engaging an outermost sheet of a stack of sheets, improved means for rotating the sheet engaging means in opposite directions to feed an engaged sheet from the stack; and Another object is to provide a modularly constructed input-output device adaptable for general use in sheet feeding systems.

SUMMARY OF THE INVENTION

According to the invention there is provided sheet feeding apparatus comprising first and second rotatable means, wherein the first means includes inwardly and outwardly facing surface portions which respectively define oppositely facing paths of travel when the first means is rotated. And, wherein the second means is disposed in the respective paths of travel of the first means. In addition, the surface portions are arranged relative to one another to permit one of the surface portions to rotate the second means in one direction, and to permit the other surface portion to rotate the second means in the opposite direction, while the first means is being rotated in a given direction.

BRIEF DESCRIPTION OF THE DRAWINGS

As shown in the drawings, wherein like reference numerals designate like or corresponding parts throughout the several figures.

Description of the Preferred Embodiments

Figure 1:
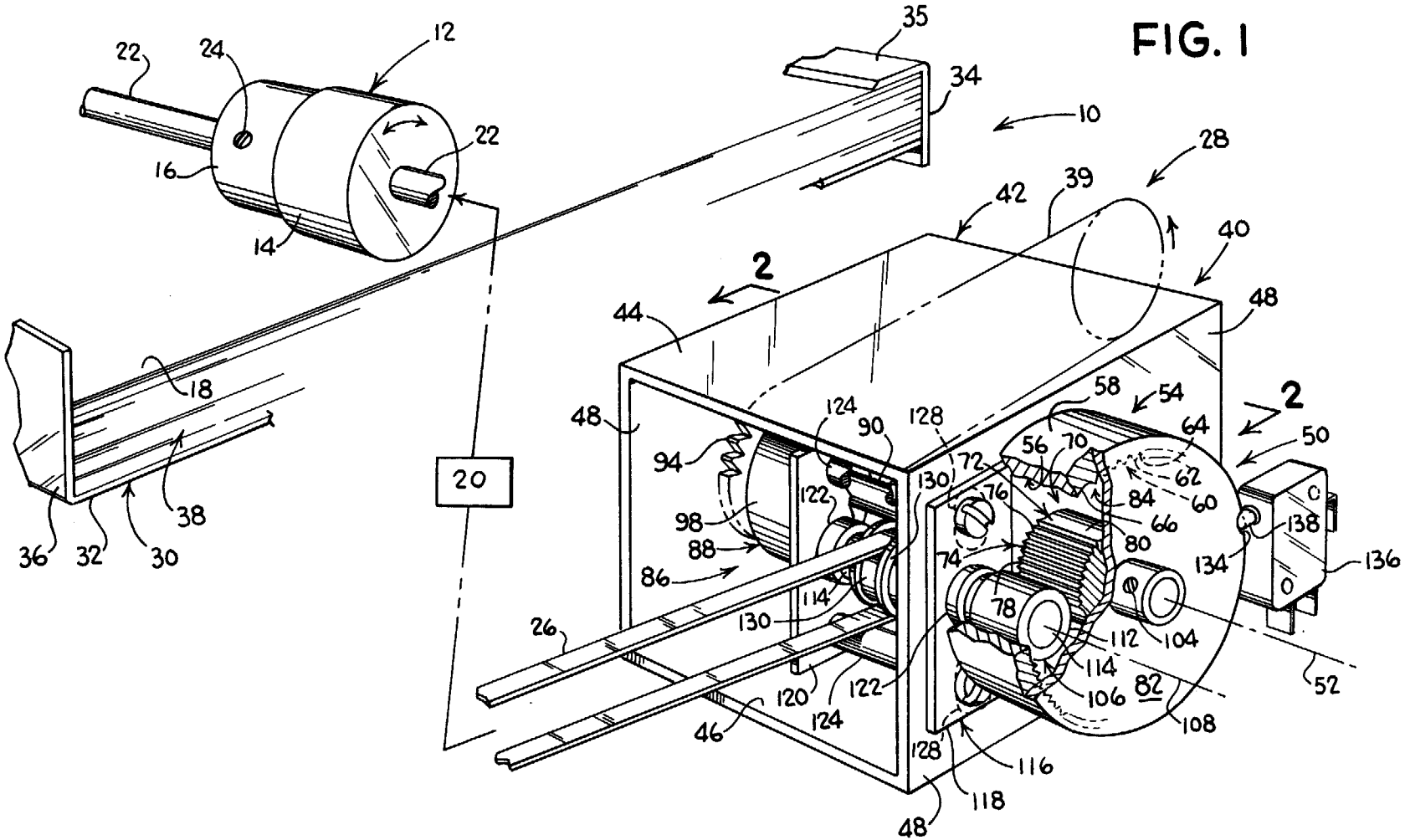
FIG. 1 is a fragmentary perspective view of sheet feeding apparatus of the type which includes a roller for engaging the topmost sheet of a stack of sheets disposed in a receptacle, including improved means for rotating the sheet engaging roller in opposite directions to feed an engaged sheet from the stack.

As shown in FIG. 1, a typical arrangement of sheet feeding apparatus 10 which may be improved in accordance with the present invention includes any well-known rotatable sheet engaging means, such as a roller 12 having a sheet engaging portion 14 and a hub portion 16. The sheet engaging roller portion 14 may be made of rubber, an elastomeric substance or any other well-known material which is suitable for frictionally gripping a sheet of material such as a paper sheet 18 for movement thereof as the roller 12 rotated. The sheet feeding apparatus 10 also includes any well-known means, schematically represented by the box 20, for transmitting rotational movement to the roller 12. The rotational movement transmitting means 20 includes one or more suitably supported, and cooperatively connected gears, shafts, sprocket wheels, chains, pulleys, and/or belts, or the like, such as an elongated drive shaft 22 to which the hub portion 16, and thus the roller 12, is suitably fixedly secured for coaxial rotation therewith as by means of a fastener 24, and an endlessly movable belt 26 adapted to be driven from a source of supply rotational movement 28.

The sheet feeding apparatus 10 (FIG. 1) is typically utilized in combination with paper storing apparatus as found in an electrostatic copying machine or copier (not shown), which apparatus includes a receptacle of the type numbered 30. As shown in FIGS. 3–6, the receptacle 30 generally includes a base wall 32, a vertically movable front wall 34 having a lip portion 35, and a rear wall 36. For illustration purposes a plurality of paper sheets 18 are shown disposed in a stack 38 within the receptacle 30, and the sheet engaging roller 12, roller drive shaft 22 and other rotational movement transmitting means 20 are shown operably associated with the receptacle 30 for feeding successive outermost sheets, such as the topmost sheet 18, one at a time from the stack 38 for processing within the copier.

The source of supply of rotational movement 28 (FIG. 1) includes an endless chain 39 adapted to be driven by well-known means including, for example, a motor (not shown) which is electrically energizeable from a local source of supply of electrical power (not shown). According to the invention, the source of rotational movement 28 also includes a modularly constructed, electromechanically operable, input-output device 40, for rotating the sheet engaging means, in the instance the roller 12, in opposite directions.

The input-output device 40 (FIG. 1) includes a frame 42 having a top wall 44, bottom wall 46, and oppositely disposed side walls 48. The walls 44, 46 and 48 are integrally connected to one another to form an elongated, hollow, open-ended, rigid structure, having a rectangularly-shaped transverse cross-section. To ensure structural rigidity, the frame 42 preferably comprises a suitably finished segment of structural steel conduit of rectangular transverse cross-section.

Figures 3, 4, 5, 6:
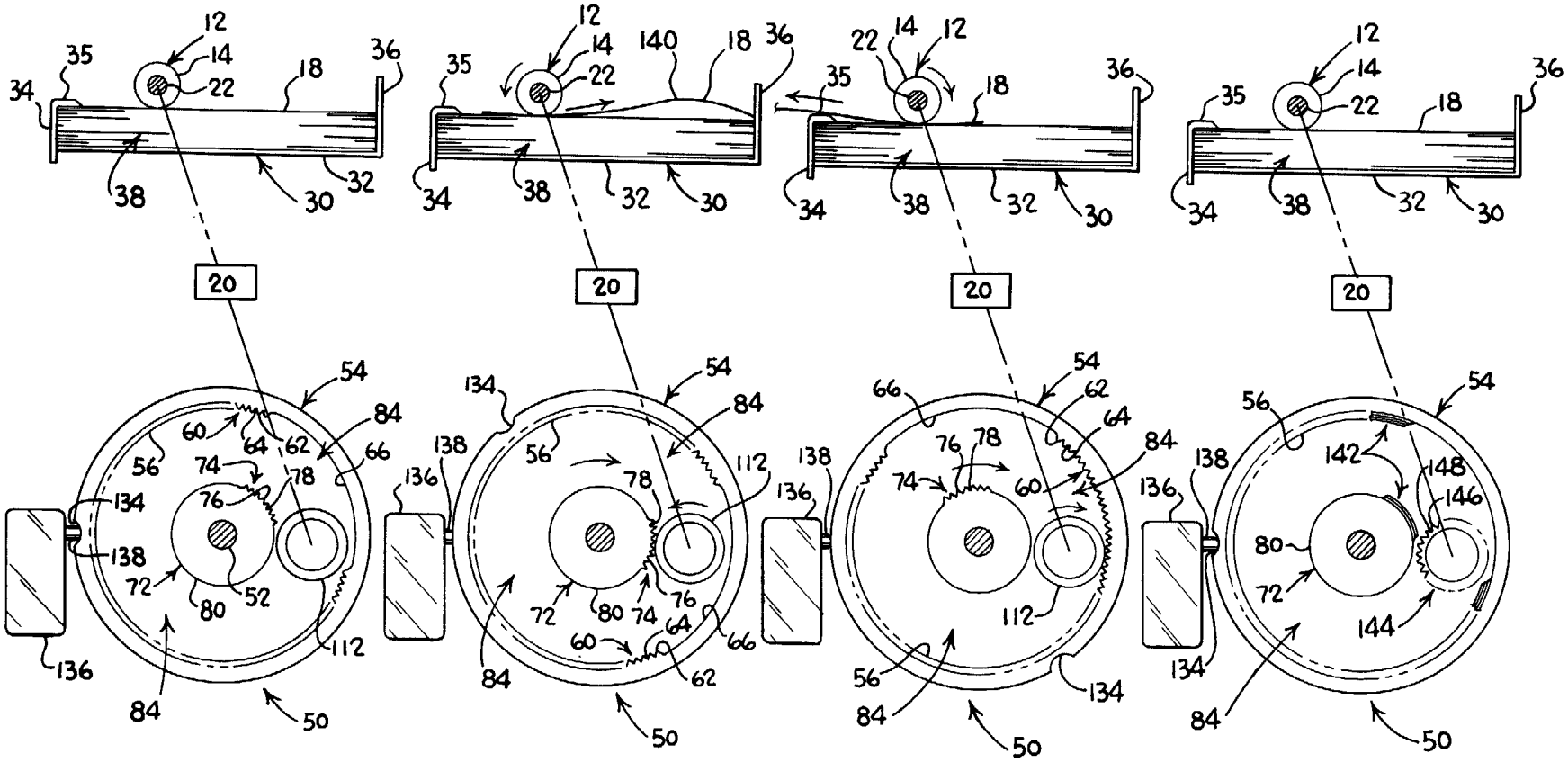
FIG. 3 is a reduced, partial cross-sectional view, in elevation, of the sheet feeding apparatus of FIG. 1, showing the rotatable input and output members of the improved means for rotating the sheet engaging roller, with the rotatable members arranged out of engagement with one another.
FIG. 4 is an elevational view, similar to FIG. 3, showing the rotating input and output members feeding the topmost sheet of the stack rearwardly from beneath the front wall lip of the receptacle in which the stack of sheets are disposed.
FIG. 5 is an elevational view similar to FIG. 3, showing the rotating input and output members feeding the topmost sheet over the front wall lip and out of the receptacle.
FIG. 6 is an elevational view, similar to FIG. 3 showing a second embodiment of the input and output members, disengaged from one another.

The input-output device 40 (FIG. 1) also includes a first, driven, rotatable member 50 having an axis of rotation 52. The first member 50 includes a cylindrically-shaped outer wall 54, having an inner surface 56 and an outer surface 58. The inner surface 56 includes a rough, inwardly-facing surface portion 60, formed by a plurality of alternate ridges 62 and grooves 64 which respectively extend parallel to the axis of rotation 52 of the member 50. The inner surface 56 also includes a smooth, inwardly-facing surface portion 66. In addition, the first rotatable member 50 includes a cylindrically-shaped hub 70, having an outer surface 72. The outer surface 72 includes a rough, outwardly-facing surface portion 74, formed by a plurality of alternate ridges 76 and grooves 78 which respectively extend parallel to the axis of rotation 52 of the member 50. The outer surface 72 also includes a smooth, outwardly-facing surface portion 80. Further, the first rotatable member 50 includes a flat, annularly-extending wall 82, integrally connecting the outer wall 54 and hub 70 to one another so as to form therewith an endless, circularly-extending channel 84. The channel 84 is U-shaped in transverse cross-section and has oppositely facing surfaces, one of which corresponds to the inner surface 56 of the outer wall 54 and the other of which corresponds to the outer surface 72 of the hub 70. Accordingly, one of the oppositely facing surfaces of the channel 84 includes the rough, inwardly-facing surface portion 60 of the outer wall 54 and the other includes the rough, outwardly-facing surface portion 74 of the hub 70. As shown in FIGS. 3–5, the roughened surface portions 60 and 74 are arranged relative to one another so as to extend through different segments of the longitudinal length of the channel 84. To ensure structural rigidity, the first member 50 preferably comprises a suitably finished, molded plastic member or metal casting.

Figure 2:
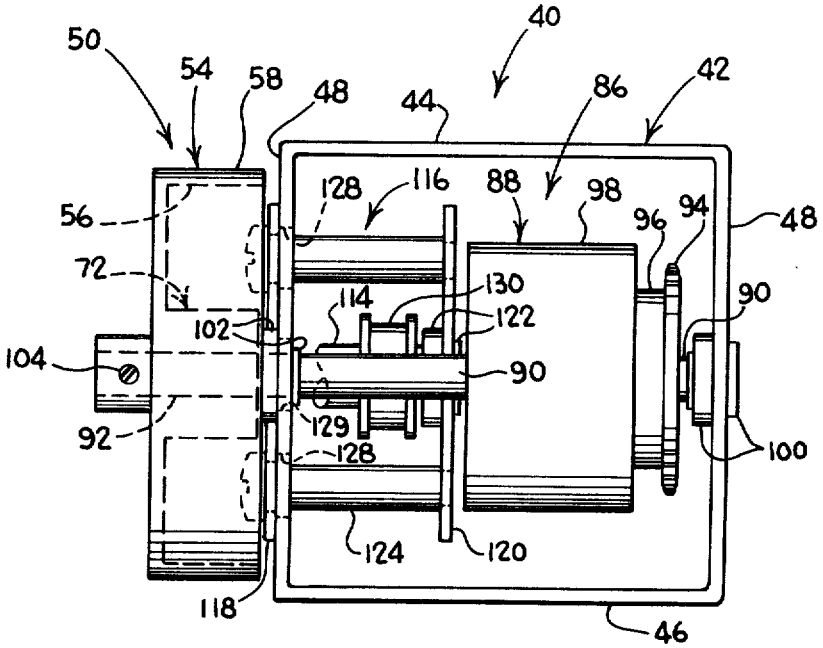
FIG. 2 is an end view of the improved means for rotating the sheet engaging roller of FIG. 1, taken substantially along the line 2—2 of FIG. 1.

The first rotatable member 50 (FIG. 1) is rotatably attached to the frame 42 with provision for intermittently driving the same from the chain 39. To that end, the input-output device 40 includes an electromagnetically operable clutch 88, an input stub shaft 90 (FIG. 2) and a sprocket wheel 94. The clutch 88, has a driving side 96 and a driven side 98. The driven side 98 includes an electromagnet (not shown) adapted by well-known means to be electrically energized from a suitable source of supply of electrical power (not shown) for energizing the clutch 88. Whereupon, the driving side 96 of the clutch 88 is attracted to and engaged by the driven side 98 of the clutch 88. The clutch sides 96 and 98 are then engaged with one another when the clutch 88 is energized and disengaged from one another when the clutch 88 is deenergized. The driving side 96 is suitably movably mounted on one of the end portions of the stub shaft 90, which shaft 90 is suitably rotatably attached to the opposite frame side walls 48, as by means of a bearings 100 and 102. And the driven side 98 of the clutch 88 is fixedly attached to the other the end portion of stub shaft 90 which end portion extends through the bearing 102 and outside of the frame 42, where the first rotatable member 50 is suitably fixedly mounted thereon for rotation therewith, as by means of a fastener 104. The sprocket wheel 94 is fixedly mounted by well-known means on the driving side 96 of the clutch 88, for continuously rotating the driving side 96 whenever the chain 39 (FIG. 1) is driven. Since energization of the clutch 88 (FIG. 2) causes the driven side 98 of the clutch 88 to magnetically attract and become engaged with the driving side 96 thereof, rotational movement of the sprocket wheel 94 is transmitted to the first member 50, via the clutch 88 and attached input shaft 90, whenever the clutch is energized, and is not transmitted to the first member 50 when the clutch 88 is deenergized.

The input-output device 40 (FIG. 1) additionally includes a second, driven, rotatable member 106, having an axis of rotation 108. The second member 106 includes a roller of suitably-shaped transverse cross-section which is made of rubber, an elastomeric substance or other resilient material to provide the same with a circumferentially extending, resilient outer surface 112 adapted to be gripped by the roughened surface portions 60 and 74 of the rotating first member 50.

The second member 106 (FIG. 1) is rotatably attached to the frame 42 with provision for adjustment of its axis of rotation 108 relative to the axis of rotation 52 of the first member 50. To that end, the device 40 includes an elongated output shaft 114, to which the second member 106 is fixedly attached, by well-known means, for coaxial rotation therewith; and a shaft supporting cage assembly 116 which is movably attached to the frame 42. The cage assembly 116 (FIG. 2) includes an outer plate 118 and an inner plate 120 a suitable pair of well-known bearing means 122, one of which is attached to each of the plates 118 and 120; and a plurality of fasteners 124 extending between the plates 118 and 120. In addition, to movably attach the cage assembly 116 to the frame 42, the frame side wall 48 which is located next adajcent to the first rotatable member 50 includes a plurality of openings 128 and an aperture 129 which are respectively dimensioned to loosely receive the fasteners 124 and shaft 114. The outer plate 118 is mounted on the outside surface of the frame side wall 48 adjacent to the first member 50, by means of the fasteners 124, which extend through the side wall openings 128 to support the inner plate 120 inside of the frame 42 and parallel to the outer plate 118. And, the shaft 114 (FIG. 1) is rotatably attached to the respective plates 118 and 120, at spaced intervals lengthwise of the shaft 114, via the respective bearing means 122, so as to dispose the second member 106 outside of the frame 42. As thus arranged, the cage assembly 116 may be moved relative to the frame 42, for adjustably fixedly positioning the second member 106 within the circularly-extending channel 84 of the first member 50, to properly locate the resilient outer surface 112 of the second member 106, in the respective paths of travel of the roughened outer surface portions, 60 and 74, of the first member 50 for engagement thereby when the first member 50 is rotated.

To transfer rotational movement of the output shaft 114 (FIG. 1) to the belt 26, the device 40 includes a pulley 130 which is fixedly attached to the shaft 114 for rotation therewith and in engagement with the belt 26. To facilitate non-slipping engagement therebetween, the pulley 130 and belt 26, may respectively be provided with a plurality of intermeshable teeth (not shown) as is well-known in the art.

In a copier, the chain 39 (FIG. 1) ordinarily continuously drives the sprocket wheel 94 whenever the copier is being utilized. And the clutch 88 is energized in response to a sheet feeding demand signal, provided by suitable well-known means within the copier, to rotate the first member 50 one revolution each time a topmost sheet 18 is to be fed from the stack 38. Typically, the sheet feeding demand signal may be utilized to momentarily energize, for example, a relay (not shown) which is connected by well-known means between the clutch 88 and local power supply, to commence rotation of the first member 50. In which instance, the input-output device 40 may include feedback means associated with the first rotatable member 50 for maintaining the clutch 88 energized for a single revolution of the first member 50. Preferably, the feedback means includes an elongated cavity 134 formed in the outer surface 58 of the first member 50, and a suitable two-position switch 136 with associated well-known circuitry. The cavity 134 is formed in the outer wall surface 58 so as to extend parallel to the axis of rotation 52 of the same. And the switch 136 is fixedly attached to the frame 42 by well-known means so as to permit the switch operating member 138 to extend into the cavity 134 when the cavity 134 is disposed in registration therewith, and to be depressed by the outer wall surface 58 when the first member 50 commences rotation. Suitable circuitry (not shown) may then be provided to electrically connect the switch 136 across the aforesaid circuitry for momentarily energizing the clutch 88, so as to connect the power source to the clutch 88 via the switch 136, whenever the switch operating member 138 is depressed; thereby maintaining the clutch 88 energized during one revolution of the first member 50 each time the demand signal momentarily energizes the clutch 88.

Assuming the input-output device 40 is mounted in a copier and the copier is being utilized, as a result of which the chain 39 (FIG. 1) is rotating the sprocket wheel 88 and thus the driving side 96 of the clutch 88, and assuming that the clutch 88 has not as yet been energized by a sheet feeding demand signal; then, the first and second rotatable members 50 and 106 (FIG. 3) are stationarily disposed out of engagement with one another. Accordingly, the output 114 (FIG. 1) pulley 130, belt 26 and other rotational movement transmitting means 20 including the roller shaft 22, and the roller 12, are stationary. And, the roller 12 (FIG. 3) is disposed at rest on the topmost sheet 18 of the stack 38. In addition, the switch operating member 138 extends from the switch 136 and into the first member's outer wall cavity 134.

When the clutch 88 (FIG. 2) is momentarily energized by a sheet feeding demand signal, the clutch sides 96 and 98 engage. As a consequence, rotational movement of the driving side 96 of the clutch 88 is transmitted through the driven side 98 to the input shaft 90, and thus to the first member 50, thereby commencing rotation of the first member 50. Assuming the first member 50 rotates clockwise as viewed in FIG. 4, the switch operating member 138 is depressed by the outer wall surface 58 of the first member 50, thereby actuating the switch 136 to maintain rotational movement of the first member 50, and initially, the outwardly facing, roughened, hub surface 74 engages and rotates the second member 106 counterclockwise. Whereupon, the output shaft 114 (FIG. 1) and pulley 130, belt 26 and other rotational movement transmitting means 20 including roller shaft 22, rotate the roller 12 counterclockwise. As shown in FIG. 4, the rotating roller 12 engages the topmost sheet 18 and urges the rear edge of the same against the rear wall 36 of the receptacle 32, thereby causing the sheet 18 to buckle and form a loop 140 therein between the roller 12 and the rear wall 36, and urges the front end of the engaged sheet 18 out from beneath the receptacle's overhanging front wall lip 35. Since the first member 50 continues to rotate clockwise, the inwardly facing, roughened, wall surface portion 60 (FIG. 5) thereafter engages and rotates the second member 106 clockwise, causing the output shaft 114 (FIG. 1) and pulley 130, belt 26 transporting means 20 including shaft 22, to rotate the roller 12 clockwise in engagement with the previously buckled sheet 18. Whereupon the roller 12 (FIG. 5) urges the previously buckled sheet 18 over the front wall lip 35 and thus out of the receptacle 30 for processing within the copier. Thereafter, continued clockwise rotation of the first member 50 rotates the outer wall cavity 134 into registration with the switch operating member 138. As a result of which the switch operating member 138 moves into the outer wall cavity 134 to disconnect the clutch 88 (FIG. 2) from the power source. Having deenergized the clutch 88, the clutch sides 96 and 98 disengage from one another, and the first member 50 stops rotating.

As shown in FIG. 6 it is within the spirit and scope of the invention that the first rotatable member 50 includes resilient means 142 at the inner surface 56 of the outer wall 54, and at the outer surface 72 of the hub 70; and that the second rotatable member 106 include either a resilient outer surface 112 (FIGS. 1–5) or a roughened outer surface 144 as shown in FIG. 6. In the latter instance the surface 144 may include, for example, a plurality of alternate ridges 146 and grooves 148 extending parallel to the axis of rotation of the first member 106. Of course, in either of these combinations, operation of the device 40 is substantially the same as hereinbefore described.

In accordance with the objects of the invention there has been described a modularly constructed electromechanical device adaptable for use in with sheet feeding apparatus of the type which includes means for engaging an outermost sheet of a stack of sheets, for rotating the sheet engaging means in opposite directions to feed an engaged sheet from the stack.

Inasmuch as certain changes may be made in the above described invention without departing from the spirit and scope of the same, it is intended that all matter contained in the above description or shown in the accompanying drawings shall be interpreted in an illustrative rather than limiting sense. And, it is intended that the following claims be interpreted to cover all the generic and specific features of the invention herein described.

What is claimed is:

1. Sheet feeding apparatus including a modularly constructed input-output device comprising:

a. a rigid mounting frame;

b. first rotatable means having a first axis of rotation, the first means including an input shaft and a first member attached thereto, the input shaft rotatably attached to the frame, the first member including an outer wall and a hub, the outer wall having an inwardly facing surface portion, the hub having an outwardly facing surface portion, the surface portions defining opposed circularly-extending paths of travel when the first means is rotated;

c. clutch means mounted on the input shaft, said clutch means adapted to be driven from a source of supply of rotational movement, said clutch means being energizeable in response to a sheet feeding demand signal for imparting the rotational movement to the input shaft for rotation of the input shaft and thus the first means in a given direction;

d. second rotatable means having a second axis of rotation, the second means including an output shaft and a second member attached thereto, means for rotatably supporting the output shaft, said supporting means movably attached to the frame to permit adjustably fixedly positioning the second rotatable means relative to the first rotatable means for proper disposition of the second member in the paths of travel of the surface portions of the first member;

e. said surface portions arranged relative to one another to permit one of said portions to rotate said second means in one direction when said first means is rotated in said given direction and to permit the other of said surface portions to rotate said second means in the opposite direction when the first means is rotated in said given direction, whereby said output shaft alternately rotates in opposite directions when said input shaft is rotated in said given direction and f. said output shaft adapted for transmitting rotational movement thereof from the device.

2. The input-output device according to claim 1 comprising said clutch means including an electrically energizeable clutch having a driving side and a driven side, said sides being disposed in engagement with one another when the clutch is energized and being disposed out of engagement with one another when the clutch is deenergized, the driving side movably attached to the input shaft and adapted for continuous rotational movement, and the driven side fixedly attached to the input shaft for movement thereof, whereby rotational movement of the driving side of the clutch is transmitted through the clutch to the first means when the clutch is energized, and whereby rotational movement of the driving side of the clutch is not transmitted through the clutch to the first means when the clutch is deenergized.

3. The input-output device according to claim 1 wherein the frame includes a segment of structural steel conduit of rectangular transverse cross-section.

4. The input-output device according to claim 1 wherein the supporting means includes a cage assembly, said cage assembly including opposed parallel disposed plates respectively adapted for rotatably supporting the output shaft and including a plurality of fasteners extending between the plates, and said frame including apertures for loosely receiving the fasteners, whereby the cage assembly and thus the output shaft may be moved relative to the frame for adjustably fixedly positioning the second member relative to the first member.

5. The input-output device according to claim 1 wherein the first member is a molded plastic member to ensure structural rigidity thereof.

6. The input-output device according to claim 1 including feedback means for maintaining the clutch means energized for at least a single revolution of the first member after energization thereof by a sheet feeding demand signal.

7. The input-output device according to claim 6, wherein said feedback means includes a switch fixedly attached to the frame and associated with the first member, and said feedback means including said first member adapted to actuate said switch during each revolution of the first member.

* * * * *